US005341958A

United States Patent [19]

Bayat et al.

[11] Patent Number: 5,341,958

[45] Date of Patent: Aug. 30, 1994

[54] POWER OPERATED CAULKING TOOL

[76] Inventors: John J. Bayat; Daniel J. Bayat, both of 3501 Cashill Blvd., Reno, Nev. 89509

[21] Appl. No.: 996,758

[22] Filed: Dec. 24, 1992

[51] Int. Cl.[5] ..... B67D 5/08

[52] U.S. Cl. ..... 222/63; 222/333; 222/390

[58] Field of Search ..... 222/63, 333, 390

[56] References Cited

U.S. PATENT DOCUMENTS

| | | | |
|---|---|---|---|
| 3,208,638 | 9/1965 | Frenzel et al. | 222/390 X |
| 3,635,378 | 1/1972 | DeHart | 222/333 X |
| 3,854,629 | 12/1974 | Blieberger | 222/333 X |
| 4,114,781 | 9/1978 | Doyel | 222/333 X |
| 4,180,187 | 12/1979 | Ben-Haim | 222/390 X |
| 4,234,104 | 11/1980 | Apuzzo, Jr. et al. | 222/333 X |
| 4,306,671 | 12/1981 | Fisher | 222/390 X |
| 4,322,022 | 3/1982 | Bergman | 222/390 X |
| 4,335,834 | 6/1982 | Zepkin | 222/390 X |
| 4,986,454 | 1/1991 | Riley | 222/390 X |
| 5,027,984 | 7/1991 | Gakhar et al. | 222/390 X |
| 5,058,781 | 10/1991 | Aronie et al. | 222/390 X |

FOREIGN PATENT DOCUMENTS

| | | | |
|---|---|---|---|
| 99231 | 4/1991 | Japan | 222/390 |

*Primary Examiner*—Gregory L. Huson

*Attorney, Agent, or Firm*—Flehr, Hohbach, Test, Albritton & Herbert

[57] ABSTRACT

Caulking tool having a holder for receiving a tube of caulking material or the like, an elongated threaded shaft movable axially of the holder and adapted for driving engagement with the piston-like member which expels the material from the tube, and an electrically actuated drive motor operably connected to the shaft for advancing the shaft axially of the holder to drive the piston-like member toward the nozzle to expel the material.

8 Claims, 2 Drawing Sheets

POWER OPERATED CAULKING TOOL

FIELD OF THE INVENTION

This invention pertains generally to the application of products such caulking materials and adhesives and, more particularly, to a power operated caulking tool for use in applying caulking, adhesives and the like.

BACKGROUND

Materials such as caulking materials and adhesives utilized in construction come in a tubular container having a tapered tip or nozzle at one end thereof and an axially movable piston-like member at the other end for forcing the material out of the tube. Such tubes are used in conjunction with caulking guns which have manually operated mechanisms for driving the piston-like member within the tube to expel the material.

OBJECTS AND SUMMARY OF THE INVENTION

It is in general an object of the invention to provide a new and improved tool for use in applying materials such as caulking and adhesive materials.

Another object of the invention is to provide a tool of the above character which is power operated.

These and other objects are achieved in accordance with the invention by providing a caulking tool having a holder for receiving a tube of caulking material or the like, an elongated threaded shaft movable axially of the holder and adapted for driving engagement with the piston-like member which expels the material from the tube, and electrically actuated drive means threadedly engaged with the shaft for advancing the shaft axially of the holder to drive the piston-like member toward the nozzle to expel the material.

DETAILED DESCRIPTION

Figures 1, 2:
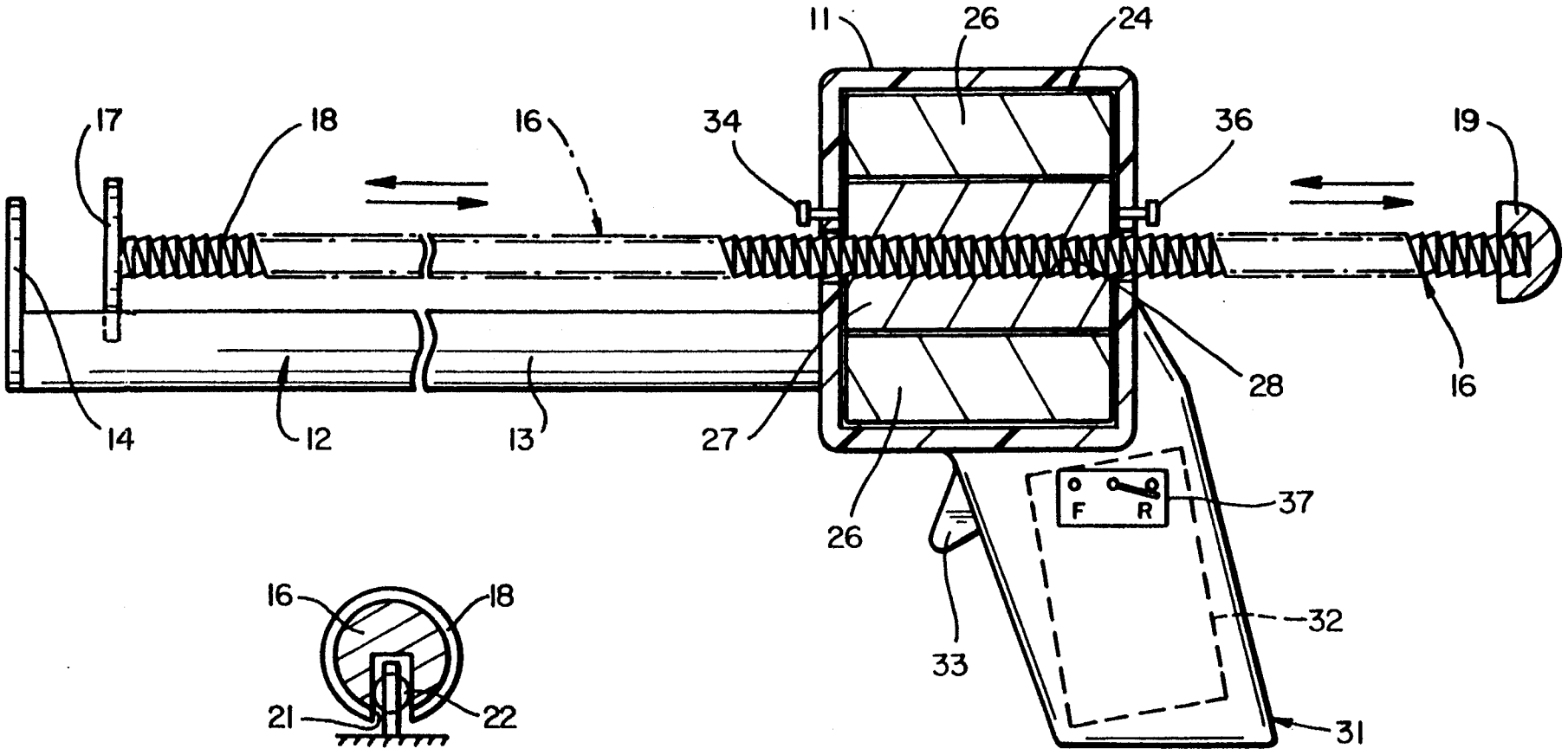
FIG. 1 is a side elevational view, partly broken away, of one embodiment of a caulking tool according to the invention.
FIG. 2 is an enlarged cross-sectional view of the embodiment of FIG. 1.

As illustrated in FIG. 1, the caulking tool includes a housing 11 to which is affixed a cradle-like holder or boat 12 for receiving a tube of caulking material or the like and holding the same in a predetermined fixed position relative to the housing. The holder includes a semi-cylindrical bottom wall 13 which forms a tray in which the body of the tube rests, with an end wall or stop 14 at the forward end thereof for abutting engagement with the end of the caulking tube from which the nozzle extends. The end wall is formed with an opening through which the nozzle projects.

A threaded shaft 16 extends axially of the holder 12 and through the housing, with a circular push plate 17 at the forward end of the shaft for driving engagement with the piston-like element in the tube of caulking material. The shaft has a helical external thread 18, with a semispherical nut 19 mounted on the end of the shaft opposite the push plate for safety and to operate a limit switch as discussed more fully hereinafter.

The shaft is mounted to the housing for axial movement relative to the housing and the tube holder, and is constrained against rotation. In this regard the shaft has a longitudinally extending slot 21 of generally rectangular cross-section, with ball bearings 22 carried by the housing engaging the walls of the slot.

An electrically energized drive motor 24 is mounted in the housing and operatively to the shaft for driving the shaft along its axis. The motor comprises a stator 26 which is affixed to the housing and a rotor 27 which rotates within the stator while being constrained against axial movement. The rotor has an axially extending internal thread 28 which engages the thread on the shaft and drives the shaft along the axis.

A handle 31 projects from the housing and is adapted to be gripped by the hand of a person using the tool. A battery 32 for powering the motor is mounted within the handle and can, for example, be a rechargeable type such as a NiCad battery. Alternatively, the motor can be operated with power from a wall outlet through a suitable cord (not shown).

Energization of the drive motor is controlled by a trigger switch 33 which projects from the front side of the handle in position to be actuated by the forefinger of a hand holding the tool by the handle. Limit switches 34, 36 are mounted on the front and rear sides of the housing to limit travel of the shaft, and to reverse the direction of the motor and, hence the direction in which the shaft advances. These switches are engaged by push plate 17 and nut 19 as the shaft approaches the ends of its travel to deenergize the motor and reverse the polarity of the current supplied to the motor when it is once again actuated by closure of trigger switch 33. An additional switch 37 is mounted on the side of the handle and connected to the motor to provide means for manually stopping and reversing the direction of the motor and, hence, the shaft.

Operation and use of the caulking tool is as follows. Trigger switch 33 is closed to operate the drive motor in the reverse direction until push plate 17 engages limit switch 34 which deenergizes the motor. A tube caulking material or the like is placed in boat 12, with the front end of the tube abutting against stop plate 14 and the nozzle on the tube projecting through the opening in the plate. When trigger switch 33 is once again closed, the motor drives the shaft in the forward direction, bringing push plate 17 into contact with the piston-like member in the caulking tube and thereafter driving the member into the tube to expel the material through the nozzle. When nut 19 actuates limit switch 36, the motor is deenergized, and the polarity of the drive current is reversed. Trigger switch 33 is then closed again to operated the motor in the reverse direction to drive the shaft to its fully withdrawn position where push plate 17 actuates limit switch 34. The empty tube of caulking material or the like is then removed from the boat and replaced with a new tube. At any point in the operating cycle, the drive motor can be stopped and/or reversed manually by switch 37.

Figure 3:
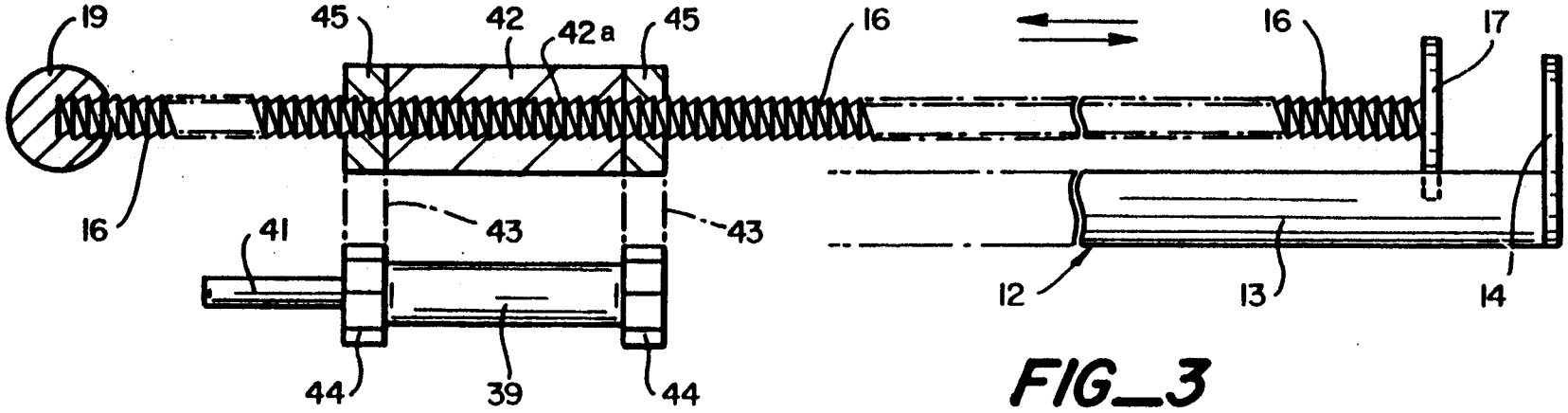
FIGS. 3 and 4 are fragmentary views of additional embodiments of a caulking tool according to the invention.

The embodiment of FIG. 3 is generally similar to the embodiment of FIG. 1, and like reference numerals designate corresponding elements in the two embodiments. In the embodiment of FIG. 3, however, the tube holder or boat is adapted to be mounted to the housing of a hand-held electric motor (not shown), with a drive shaft 39 having a shank 41 adapted to be received in the chuck of the drill.

A rotor 42 is rotatively mounted on shaft 16, with an axially extending internal thread 42*a* in driving engagement with the helical thread on the shaft. This rotor is driven by a pair of chains 43 which are trained about drive sprockets 44 on drive shaft 39 and sprockets 45 on the rotor itself.

Alternatively, rather than having drive shaft 39 driven by a drill motor, the embodiment of FIG. 3 can be constructed in a self-contained form by utilizing a drive motor in place of the drive shaft, with switches for controlling operation of the motor as in the embodiment of FIG. 1.

Figure 4:
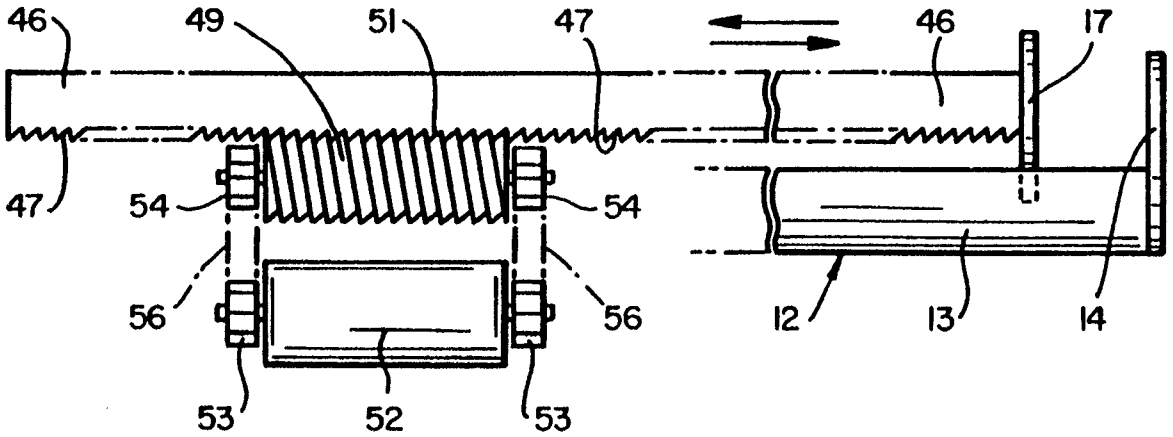
Figure 5:
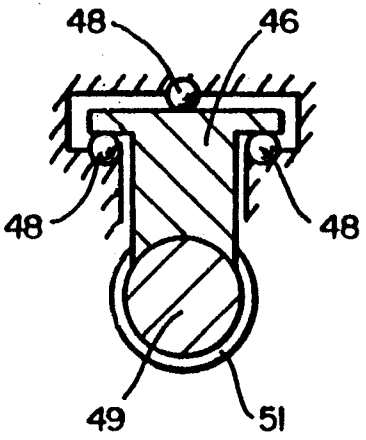
FIG. 5 is an enlarged cross-sectional view of the embodiment of FIG. 4.

The embodiment of FIG. 4 is likewise similar to the other embodiments, and corresponding elements are again designated by like reference numerals. In the embodiment of FIG. 4, the actuator shaft 46 has a generally T-shaped cross-section, with a concave helical thread segment 47 on the lower side thereof. This shaft is supported for axial movement and constrained against rotation by roller bearings 48 carried by the drive housing.

Shaft 46 is driven by a rotor 49 which has helical teeth 51 similar to a worm gear in driving engagement with the thread segment or teeth on the lower side of the shaft. Rotor 49 is driven by a drive motor 52 through sprockets 53, 54 and chains 56 located in the drive housing. Alternatively, the caulking tube holder can be mounted to the housing of an electrical drill, and drive motor 52 can be replaced with a shaft driven by the drill motor as in the embodiment of FIG. 3.

The caulker can likewise be utilized with tools powered by other means, such as pneumatically, by mounting the tube holder on the tool and providing a driving connection between the rotor or chuck of the tool and the drive shaft of the caulker.

It is apparent from the foregoing that a new and improved caulking tool has been provided. While only certain presently preferred embodiments have been described in detail, as will be apparent to those familiar with the art, certain changes and modifications can be made without departing from the scope of the invention as defined by the following claims.

We claim:

1. A caulking tool for use with a tube of material having an elongated body with a nozzle at one end thereof and an axially movable piston-like member for driving the material through the nozzle, comprising a cradle-like holder for holding the body of the tube in a predetermined position, an elongated threaded shaft movable axially of the holder, means constraining the shaft against rotation relative to the holder, a housing affixed to the holder, with the shaft passing through the housing, power operated drive means engaged with the shaft within the housing for advancing the shaft axially of the holder to drive the piston-like member in a forward direction toward the nozzle to expel the material from the tube, means responsive to movement of the shaft to a predetermined position in the forward direction for conditioning the drive means to reverse the direction of shaft travel, and means responsive to movement of the shaft to a predetermined position in the reverse direction for deenergizing the drive means.

2. The caulking tool of claim 1 wherein the shaft has an external helical thread and the drive means comprises a rotor having an axially extending internal thread in driving engagement with the helical thread.

3. The caulking tool of claim 2 wherein the rotor comprises the rotor of an electrically energizable motor.

4. The caulking tool of claim 2 wherein the drive means further includes a drive motor operably connected to the rotor.

5. The caulking tool of claim 1 wherein the drive means includes a rotary drive element positioned to one side of and in peripheral driving engagement with the threaded shaft.

6. A tool for dispensing a caulking material from a container having a tubular body with a nozzle at one end of the body and a piston-like member movable axially within the body for driving the material out of the container through the nozzle, comprising holding means for receiving the tubular body and holding the body in a relatively fixed position, an elongated shaft movable axially of the holding means for driving the piston-like member toward the nozzle to expel the material from the container, and power operated drive means including a worm gear rotatable about an axis parallel to the shaft with helical teeth engaged with the shaft for advancing the shaft axially of the holding means to drive the piston-like member toward the nozzle to expel the material from the container.

7. The tool of claim 6 including switch means responsive to movement of the shaft for deenergizing the drive means and conditioning the drive means to drive the shaft in a reverse direction when the shaft advances to a predetermined point.

8. A tool for dispensing a caulking material from a container having a tubular body with a nozzle at one end of the body and a piston-like member movable axially within the body for driving the material out of the container through the nozzle, comprising a housing, means affixed to the housing for holding the tubular body of the container in a predetermined position relative to the housing, a shaft having drive teeth on one side thereof for driving the piston-like member toward the nozzle to expel the caulking material from the container, electrically energizable drive means including a worm gear rotatable about an axis parallel to the shaft with helical teeth engaged in driving engagement with the teeth on the shaft for advancing the shaft in a forward direction to drive the piston-like member to expel the material from the container, a handle projecting from the housing and adapted to be held in the hand of a person using the tool, a battery mounted within the handle for energizing the drive means, and means responsive to movement to the shaft to predetermined positions both in the forward direction and in a reverse direction for reversing the polarity of current supplied to the drive means from the battery.

* * * * *